US007950461B2

(12) United States Patent
Schrader et al.

(10) Patent No.: US 7,950,461 B2
(45) Date of Patent: May 31, 2011

(54) SCREENED VALVE SYSTEM FOR SELECTIVE WELL STIMULATION AND CONTROL

(75) Inventors: Kirby G. Schrader, Magnolia, TX (US); Alfred R. Curington, The Woodlands, TX (US); Bharathwaj Kannan, Sg. Bera Seria (BN)

(73) Assignee: Welldynamics, Inc., Spring, TX (US)

( * ) Notice: Subject to any disclaimer, the term of this patent is extended or adjusted under 35 U.S.C. 154(b) by 0 days.

(21) Appl. No.: 12/275,666

(22) Filed: Nov. 21, 2008

(65) Prior Publication Data

US 2009/0139728 A1 Jun. 4, 2009

(30) Foreign Application Priority Data

Nov. 30, 2007 (WO) ..... PCT/US07/86132

(51) Int. Cl.
*E21B 43/16* (2006.01)
*E21B 43/08* (2006.01)
*E21B 34/10* (2006.01)

(52) U.S. Cl. ..... 166/305.1; 166/205; 166/320; 166/375; 166/386

(58) Field of Classification Search ..... 166/375, 166/386, 320, 205, 305.1
See application file for complete search history.

(56) References Cited

U.S. PATENT DOCUMENTS 2,512,226 A 6/1950 Edwards
4,949,788 A 8/1990 Szarka et al.
4,967,845 A * 11/1990 Shirk ..... 166/386
5,676,208 A 10/1997 Finley
5,872,876 A 2/1999 Kluth et al.
6,397,949 B1 * 6/2002 Walker et al. ..... 166/374
6,488,082 B2 12/2002 Echols et al.
6,568,481 B2 5/2003 Koehler et al.
6,659,186 B2 * 12/2003 Patel ..... 166/386
6,729,393 B2 5/2004 Vincent et al.
6,761,219 B2 7/2004 Snider et al.
7,267,172 B2 9/2007 Hofman (Continued)

FOREIGN PATENT DOCUMENTS

WO 9737102 A2 10/1997

(Continued)

OTHER PUBLICATIONS

International Preliminary Report on Patentability with Written Opinion issued Aug. 8, 2009, for International Application Serial No. PCT/US07/061031, 6 pages.

(Continued)

*Primary Examiner* — Jennifer H Gay
(74) *Attorney, Agent, or Firm* — Marlin R. Smith

(57) ABSTRACT

A well system includes a valve interconnected in a casing string and selectively configurable between first and second configurations via a line external to the casing string, the valve in the first configuration being operable to selectively permit and prevent fluid flow between the casing string exterior and interior, and in the second configuration to selectively filter and prevent fluid flow between the casing string exterior and interior. A method of selectively stimulating a formation includes: positioning a casing string in a wellbore intersecting the formation, the casing string including a valve operable via an external line to selectively permit and prevent fluid flow between the casing string interior and exterior; and stimulating an interval set of the formation by opening the valve, flowing a stimulation fluid from the casing string into the interval set, and then configuring the valve to filter formation fluid which flows into the casing string.

20 Claims, 7 Drawing Sheets

U.S. PATENT DOCUMENTS

| | | | | |
|---|---|---|---|---|
| 7,273,106 | B2 * | 9/2007 | Huckabee et al. | 166/369 |
| 7,387,165 | B2 * | 6/2008 | Lopez de Cardenas et al. | 166/313 |
| 7,478,676 | B2 | 1/2009 | East, Jr. et al. | |
| 7,604,055 | B2 * | 10/2009 | Richard et al. | 166/308.1 |
| 7,690,432 | B2 | 4/2010 | Noske et al. | |
| 2002/0112862 | A1 * | 8/2002 | Patel | 166/386 |
| 2003/0178203 | A1 * | 9/2003 | Griffiths | 166/381 |
| 2004/0020652 | A1 * | 2/2004 | Campbell et al. | 166/313 |
| 2004/0035578 | A1 * | 2/2004 | Ross et al. | 166/250.15 |
| 2004/0084189 | A1 * | 5/2004 | Hosie et al. | 166/386 |
| 2004/0168800 | A1 | 9/2004 | Sask | |
| 2006/0124310 | A1 | 6/2006 | Lopez De Cardenas et al. | |
| 2006/0124315 | A1 | 6/2006 | Frazier et al. | |
| 2007/0272411 | A1 * | 11/2007 | Lopez De Cardenas et al. | 166/305.1 |
| 2008/0156496 | A1 | 7/2008 | East, Jr. | |
| 2009/0044944 | A1 * | 2/2009 | Murray et al. | 166/308.1 |
| 2009/0056934 | A1 | 3/2009 | Xu | |
| 2009/0084553 | A1 * | 4/2009 | Rytlewski et al. | 166/305.1 |
| 2009/0139728 | A1 * | 6/2009 | Schrader et al. | 166/373 |

FOREIGN PATENT DOCUMENTS

| | | | |
|---|---|---|---|
| WO | 9749894 | A1 | 12/1997 |
| WO | 9812417 | A1 | 3/1998 |

OTHER PUBLICATIONS

Excape product brochure, 2000, 1 page.
Case History, "RapidMATRIX HZ Horizontal Acidizing System Is Used Field Wide to Produce Excellent Results," undated, 1 page.
Case History, "StackFRAC HZ Horizontal Fracturing/Stimulation System Achieves Best in Field Results," undated, 1 page.
CBM Zone Monitoring, Packers Plus brochure, undated, 1 page.
Halliburton Drawing No. 00017600, Oct. 12, 2005, 6 pages.
International Search Report and Written Opinion issued Jan. 4, 2008, for International Patent Application Serial No. PCT/US07/61031, 12 pages.
International Search Report and Written Opinion issued Jun. 25, 2008, for International Patent Application Serial No. PCT/US07/86132, 8 pages.
Excape Completion Process, "Your Fastest Path to Profit," product brochure, Marathon Oil Co., BJ Services Co., and The Expo Group, 2004, 5 pages.
Garner, J. Jay, et al., "Casing-Conveyed Perforating System Presents a Unique Set of Drilling and Cementing Challenges: A Case History Study—Kenai Gas Field, Alaska," SPE 79877, 2003, 11 pages.
McDaniel, B.W., et al., "Review of Current Fracture Stimulation Techniques for Best Economics in Multilayer, Lower-Permeability Reservoirs," SPE 98025, 2005, 19 pages.
Packers Plus, "Stack Frac™ Multi-Stage Fracturing Systems," product brochure, undated, 4 pages.
Halliburton Drawing No. 00239025, Feb. 21, 2006, 12 pages.
Halliburton Drawing No. 00254021, Jul. 13, 2006, 12 pages.
Excape Completion Process Eccentric Centralizer product brochure, Turbeco, undated, 2 pages.
Halliburton product brochure, Cobra Frac Service, Aug. 2005, 2 pages.
Halliburton product brochure, "FracDoor Sliding Side-Door Circulation and Production Sleeve," Feb. 2006, 2 pages.
Halliburton product brochure, CobraMax Fracturing Service, May 2005, 2 pages.
Halliburton product brochure, "Delta Stim Sleeve," Feb. 2006, 2 pages.
Packers Plus product brochure, RapidMATRIX Multi-Stage Stimulation Systems, undated, 4 pages.
Rodgerson, J.L., et al., "External Casing Perforating Provides Optimal Treatment Coverage in Horizontal Pay," SPE 97175, 2005, 6 pages.
Packers Plus product brochure, Vertical Cased Hole StackFRAC, undated, 1 page.
Packers Plus product brochure, ZoneBoss Intelligent Well Systems, undated, 1 page.
International Preliminary Report on Patentability and Written Opinion issued Jun. 10, 2010, for International Patent Application No. PCT/US07/086132, 6 pages.
EP Search Report issued Nov. 11, 2010, for EP Patent Application No. 07865030, 4 pages.

* cited by examiner

SCREENED VALVE SYSTEM FOR SELECTIVE WELL STIMULATION AND CONTROL

CROSS-REFERENCE TO RELATED APPLICATION

The present application claims the benefit under 35 USC §119 of the filing date of International Application No. PCT/US07/86132, filed Nov. 30, 2007. The entire disclosure of this prior application is incorporated herein by this reference.

BACKGROUND

The present invention relates generally to equipment utilized and operations performed in conjunction with a subterranean well and, in an embodiment described herein, more particularly provides a well system with screened valves for selective well stimulation and control.

Several systems have been used in the past for selectively fracturing individual zones in a well. In one such system, a coiled tubing string is used to open and close valves in a casing string. In another system, balls are dropped into the casing string and pressure is applied to shift sleeves of valves in the casing string.

It will be appreciated that use of coiled tubing and balls dropped into the casing string obstruct the interior of the casing string. This reduces the flow area available for pumping stimulation fluids into the zone. Where the stimulation fluid includes an abrasive proppant, ball seats will likely be eroded by the fluid flow.

Furthermore, these prior systems do not include any means for preventing proppant, formation fines, etc. from flowing into the casing string after a stimulation operation has been concluded, for example, during testing, completion or production operations.

Therefore, it may be seen that improvements are needed in the art of selectively stimulating and controlling flow in a well.

SUMMARY

In carrying out the principles of the present invention, a well system and associated method are provided which solve at least one problem in the art. One example is described below in which the well system includes casing valves remotely operable via one or more lines, without requiring intervention into the casing, and without requiring balls to be dropped into, or pressure to be applied to, the casing. Another example is described below in which the lines and valves are cemented in a wellbore with the casing, and the valves are openable and closeable after the cementing operation. A valve described below includes a filtering configuration in which proppant, formation fines, etc. can be filtered from formation fluid flowing into the casing.

In one aspect, a unique well system is provided. The well system includes at least one valve interconnected in a casing string. The valve is selectively configurable between first and second configurations via at least one line external to the casing string. The valve in the first configuration is operable to selectively permit and prevent fluid flow between an exterior and an interior of the casing string. The valve in the second configuration is operable to selectively filter and prevent fluid flow between the exterior and interior of the casing string.

In another aspect, a valve for use in a tubular string in a subterranean well is provided. The valve includes a closure member displaceable between open and closed positions to thereby selectively permit and prevent flow through a sidewall of a housing assembly when the valve is in a first configuration. The closure member is further displaceable between closed and filtering positions to thereby selectively prevent and filter flow through the housing assembly sidewall when the valve is in a second configuration. The valve is selectively configurable between the first and second configurations from a remote location without intervention into the well.

In yet another aspect, a method of selectively stimulating a subterranean formation is provided which includes the steps of: positioning a casing string in a wellbore intersecting the formation, the casing string including at least one valve operable to selectively permit and prevent fluid flow between an interior and an exterior of the casing string, the valve being operable via at least one line externally connected to the valve; and for at least one interval set of the formation, stimulating the interval set by opening the valve, flowing a stimulation fluid from the interior of the casing string and into the interval set, and then configuring the valve to filter fluid which flows from the formation into the casing string.

These and other features, advantages, benefits and objects of the present invention will become apparent to one of ordinary skill in the art upon careful consideration of the detailed description of representative embodiments of the invention hereinbelow and the accompanying drawings, in which similar elements are indicated in the various figures using the same reference numbers.

DETAILED DESCRIPTION

It is to be understood that the various embodiments of the present invention described herein may be utilized in various orientations, such as inclined, inverted, horizontal, vertical, etc., and in various configurations, without departing from the principles of the present invention. The embodiments are described merely as examples of useful applications of the principles of the invention, which is not limited to any specific details of these embodiments.

In the following description of the representative embodiments of the invention, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
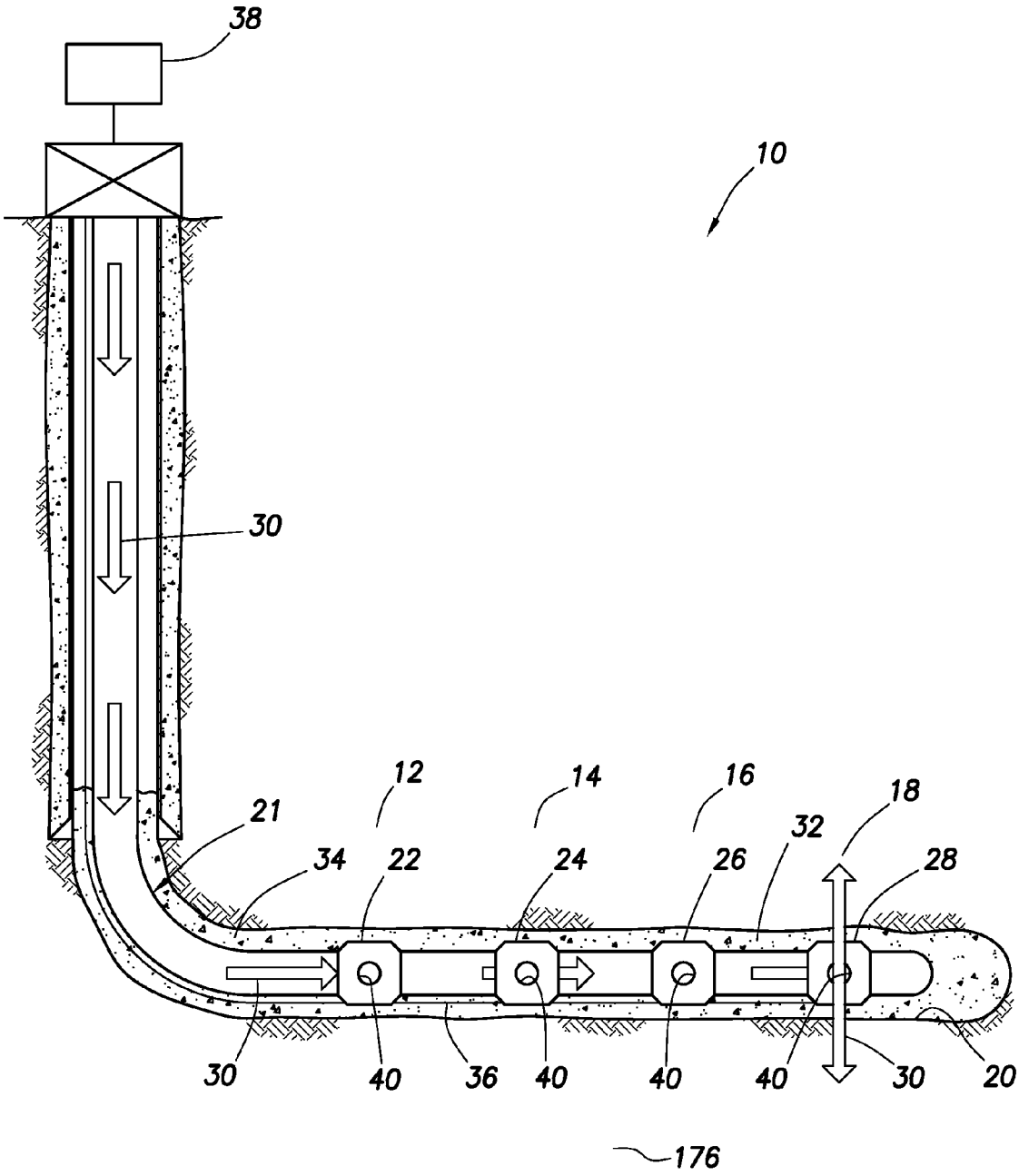
FIG. 1 is a schematic partially cross-sectional view of a well system and associated method embodying principles of the present invention.

Representatively illustrated in FIG. 1 is a well system 10 and associated method which embody principles of the present invention. The system 10 and method are used to selectively stimulate multiple sets of one or more intervals 12, 14, 16, 18 of a formation 176 intersected by a wellbore 20.

Each of the interval sets 12, 14, 16, 18 may include one or more intervals of the formation 176. As depicted in FIG. 1, there are four of the interval sets 12, 14, 16, 18, and the wellbore 20 is substantially horizontal in the intervals, but it should be clearly understood that any number of intervals may exist, and the wellbore could be vertical or inclined in any direction, in keeping with the principles of the invention.

A casing string 21 is installed in the wellbore 20. As used herein, the term "casing string" is used to indicate any tubular string which is used to form a protective lining for a wellbore. Casing strings may be made of any material, such as steel, polymers, composite materials, etc. Casing strings may be jointed, segmented or continuous. Typically, casing strings are sealed to the surrounding formation using cement or another hardenable substance (such as epoxies, etc.), or by using packers or other sealing materials, in order to prevent or isolate longitudinal fluid communication through an annulus formed between the casing string and the wellbore.

The casing string 21 depicted in FIG. 1 includes four valves 22, 24, 26, 28 interconnected therein. Thus, the valves 22, 24, 26, 28 are part of the casing string 21, and are longitudinally spaced apart along the casing string.

Preferably each of the valves 22, 24, 26, 28 corresponds to one of the interval sets 12, 14, 16, 18 and is positioned in the wellbore 20 opposite the corresponding interval. However, it should be understood that any number of valves may be used in keeping with the principles of the invention, and it is not necessary for a single valve to correspond to, or be positioned opposite, a single interval. For example, multiple valves could correspond to, and be positioned opposite, a single interval, and a single valve could correspond to, and be positioned opposite, multiple intervals.

Each of the valves 22, 24, 26, 28 is selectively operable to permit and prevent fluid flow between an interior and exterior of the casing string 21. The valves 22, 24, 26, 28 could also control flow between the interior and exterior of the casing string 21 by variably choking or otherwise regulating such flow.

With the valves 22, 24, 26, 28 positioned opposite the respective interval sets 12, 14, 16, 18 as depicted in FIG. 1, the valves may also be used to selectively control flow between the interior of the casing string 21 and each of the interval sets. In this manner, each of the interval sets 12, 14, 16, 18 may be selectively stimulated by flowing stimulation fluid 30 through the casing string 21 and through any of the open valves into the corresponding interval sets.

As used herein, the term "stimulation fluid" is used to indicate any fluid, or combination of fluids, which is injected into a formation or interval set to increase a rate of fluid flow through the formation or interval set. For example, a stimulation fluid might be used to fracture the formation, to deliver proppant to fractures in the formation, to acidize the formation, to heat the formation, or to otherwise increase the mobility of fluid in the formation. Stimulation fluid may include various components, such as gels, proppants, breakers, etc.

As depicted in FIG. 1, the stimulation fluid 30 is being delivered to the interval set 18 via the open valve 28. In this manner, the interval set 18 can be selectively stimulated, such as by fracturing, acidizing, etc.

The interval set 18 is isolated from the interval set 16 in the wellbore 20 by cement 32 placed in an annulus 34 between the casing string 21 and the wellbore. The cement 32 prevents the stimulation fluid 30 from being flowed to the interval set 16 via the wellbore 20 when stimulation of the interval set 16 is not desired. The cement 32 isolates each of the interval sets 12, 14, 16, 18 from each other in the wellbore 20.

As used herein, the term "cement" is used to indicate a hardenable sealing substance which is initially sufficiently fluid to be flowed into a cavity in a wellbore, but which subsequently hardens or "sets up" so that it seals off the cavity. Conventional cementitious materials harden when they are hydrated. Other types of cements (such as epoxies or other polymers) may harden due to passage of time, application of heat, combination of certain chemical components, etc.

Each of the valves 22, 24, 26, 28 has one or more openings 40 for providing fluid communication through a sidewall of the valve. It is contemplated that the cement 32 could prevent flow between the openings 40 and the interval sets 12, 14, 16, 18 after the cement has hardened, and so various measures may be used to either prevent the cement from blocking this flow, or to remove the cement from the openings, and from between the openings and the interval sets. For example, the cement 32 could be a soluble cement (such as an acid soluble cement), and the cement in the openings 40 and between the openings and the interval sets 12, 14, 16, 18 could be dissolved by a suitable solvent in order to permit the stimulation fluid 30 to flow into the interval sets. The stimulation fluid 30 itself could be the solvent.

In the well system 10, the valve 28 is opened after the cementing operation, that is, after the cement 32 has hardened to seal off the annulus 34 between the interval sets 12, 14, 16, 18. The stimulation fluid 30 is then pumped through the casing string 21 and into the interval set 18.

The valve 28 is then closed, and the next valve 26 is opened. The stimulation fluid 30 is then pumped through the casing string 21 and into the interval set 16.

The valve 26 is then closed, and the next valve 24 is opened. The stimulation fluid 30 is then pumped through the casing string 21 and into the interval set 14.

The valve 24 is then closed, and the next valve 22 is opened. The stimulation fluid 30 is then pumped through the casing string 21 and into the interval set 12.

Thus, the valves 22, 24, 26, 28 are sequentially opened and then closed to thereby permit sequential stimulation of the corresponding interval sets 12, 14, 16, 18. Note that the valves 22, 24, 26, 28 may be opened and closed in any order, in keeping with the principles of the invention.

In a desirable feature of the well system 10 and associated method, the valves 22, 24, 26, 28 may be opened and closed as many times as is desired, the valves may be opened and closed after the cementing operation, the valves may be opened and closed without requiring any intervention into the casing string 21, the valves may be opened and closed without installing any balls or other plugging devices in the casing string, and the valves may be opened and closed without applying pressure to the casing string.

Instead, the valves 22, 24, 26, 28 are selectively and sequentially operable via one or more lines 36 which are preferably installed along with the casing string 21. In addition, the lines 36 are preferably installed external to the casing string 21, so that they do not obstruct the interior of the casing string, but this is not necessary in keeping with the principles of the invention. Note that, as depicted in FIG. 1, the lines 36 are cemented in the annulus 34 when the casing string 21 is cemented in the wellbore 20.

The lines 36 are connected to each of the valves 22, 24, 26, 28 to control operation of the valves. Preferably, the lines 36 are hydraulic lines for delivering pressurized fluid to the valves 22, 24, 26, 28, but other types of lines (such as electrical, optical fiber, etc.) could be used if desired.

The lines 36 are connected to a control system 38 at a remote location (such as the earth's surface, sea floor, floating rig, etc.). In this manner, operation of the valves 22, 24, 26, 28 can be controlled from the remote location via the lines 36, without requiring intervention into the casing string 21.

After the stimulation operation, it may be desired to test the interval sets 12, 14, 16, 18 to determine, for example, post-stimulation permeability, productivity, injectivity, etc. An individual interval set can be tested by opening its corresponding one of the valves 22, 24, 26, 28 while the other valves are closed.

Formation tests, such as buildup and drawdown tests, can be performed for each interval set 12, 14, 16, 18 by selectively opening and closing the corresponding one of the valves 22, 24, 26, 28 while the other valves are closed. Instruments, such as pressure and temperature sensors, may be included with the casing string 21 to perform downhole measurements during these tests.

The valves 22, 24, 26, 28 may also be useful during production to control the rate of production from each interval set. For example, if interval set 18 should begin to produce water, the corresponding valve 28 could be closed, or flow through the valve could be choked, to reduce the production of water.

If the well is an injection well, the valves 22, 24, 26, 28 may be useful to control placement of an injected fluid (such as water, gas, steam, etc.) into the corresponding interval sets 12, 14, 16, 18. A waterflood, steamfront, oil-gas interface, or other injection profile may be manipulated by controlling the opening, closing or choking of fluid flow through the valves 22, 24, 26, 28.

During the formation tests, completion operations, production operations, etc., when formation fluid is flowed into the casing string 21, the valves 22, 24, 26, 28 include another desirable feature, which provides for filtering the formation fluid so that proppant, formation fines, or other debris, particulate matter, etc. is not produced into the casing string. Specifically, each of the valves 22, 24, 26, 28 has another configuration in which the valve can be operated to selectively prevent and filter flow through the opening 40.

Each of the valves 22, 24, 26, 28 can be selectively configured as desired using the lines 36 and control system 38. Thus, the valves 22, 24, 26, 28 are configurable from a remote location, without requiring any intervention into the casing string 21, and without requiring that pressure be applied to the casing string.

Figure 2:
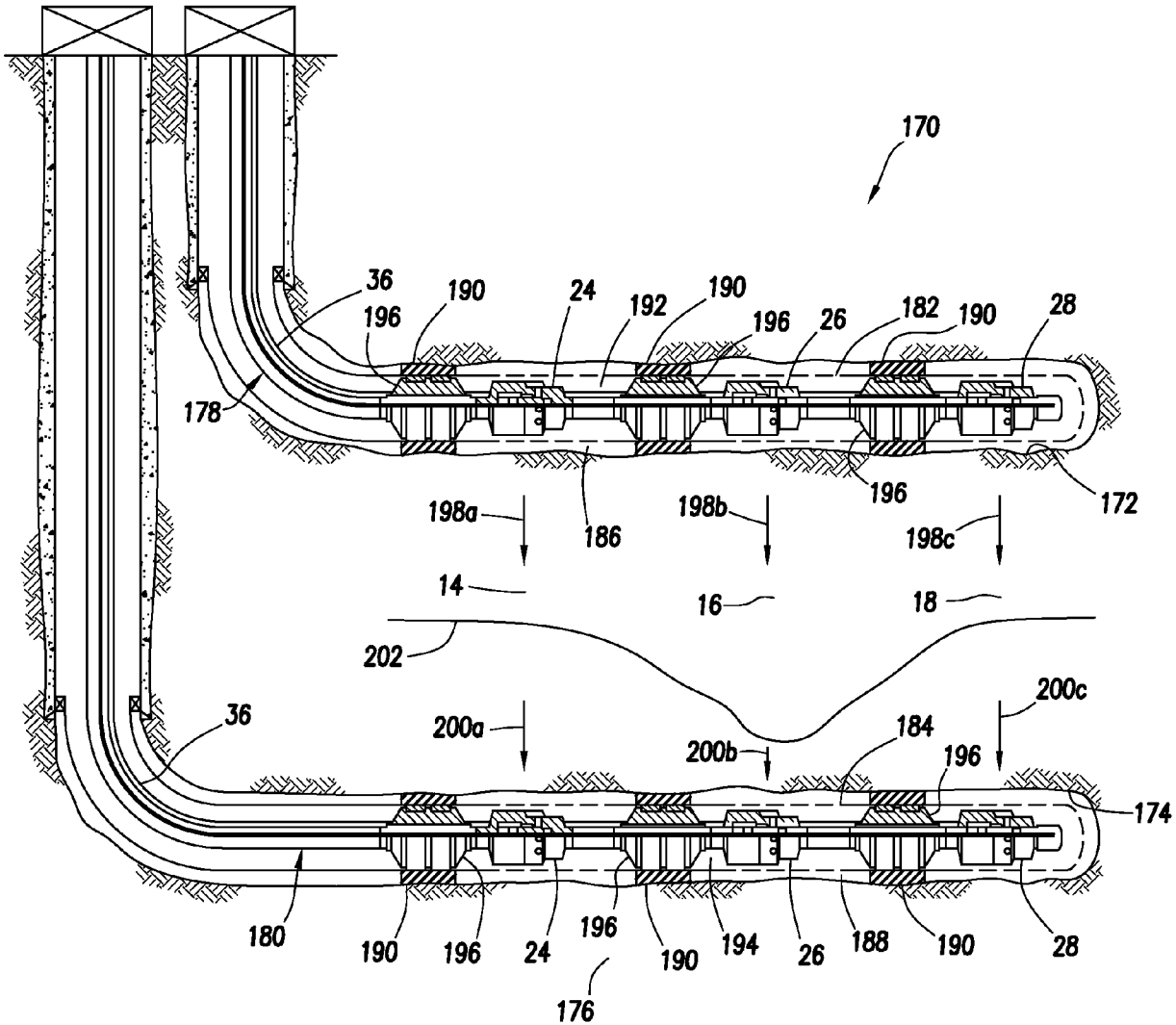
FIG. 2 is a schematic partially cross-sectional view of another well system and associated method which embody principles of the present invention.
Figure 3A:
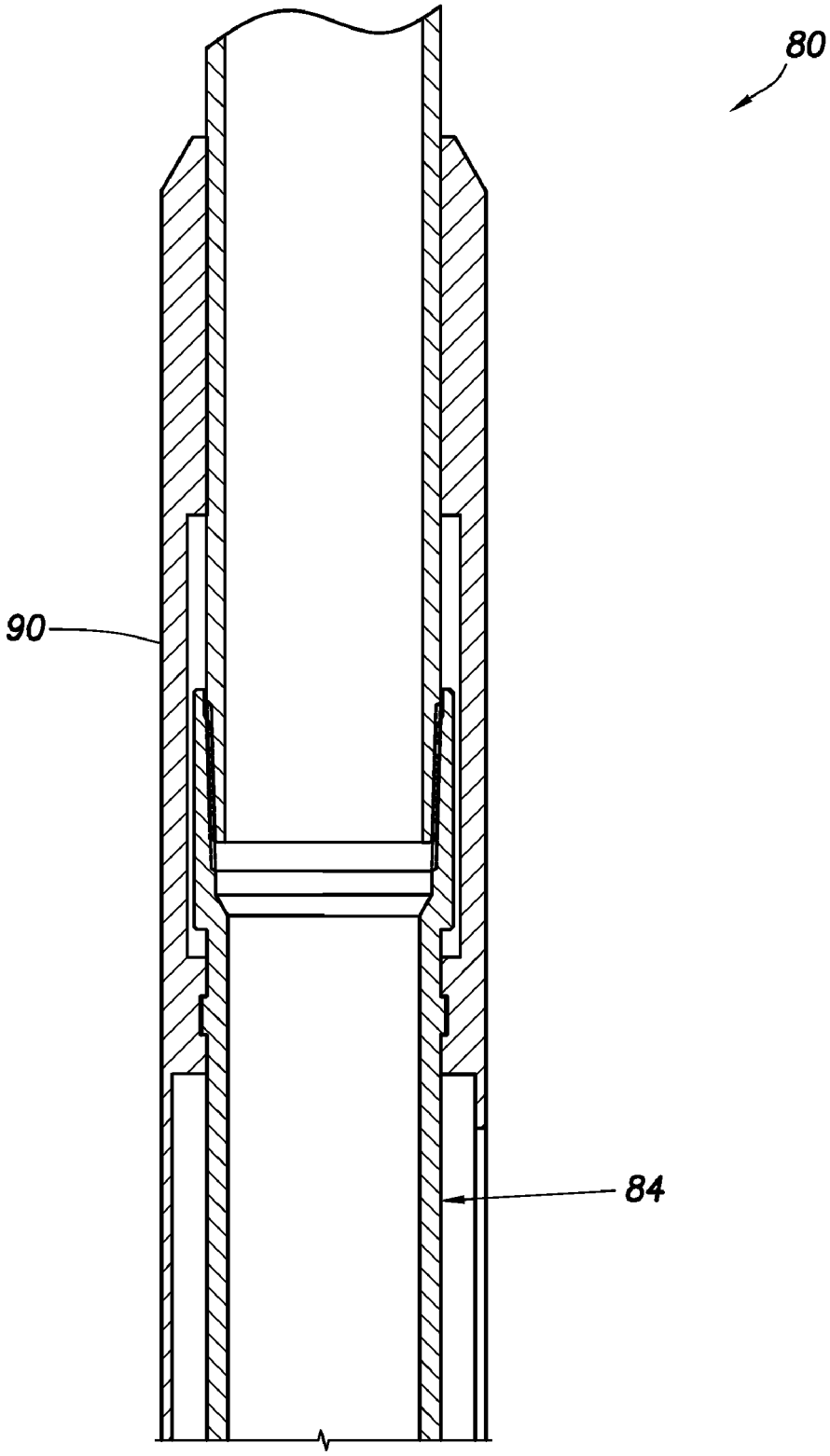
FIGS. 3A-E are schematic cross-sectional views of successive axial sections of a valve which may be used in the well systems and methods of FIGS. 1 & 2.
Figure 3B:
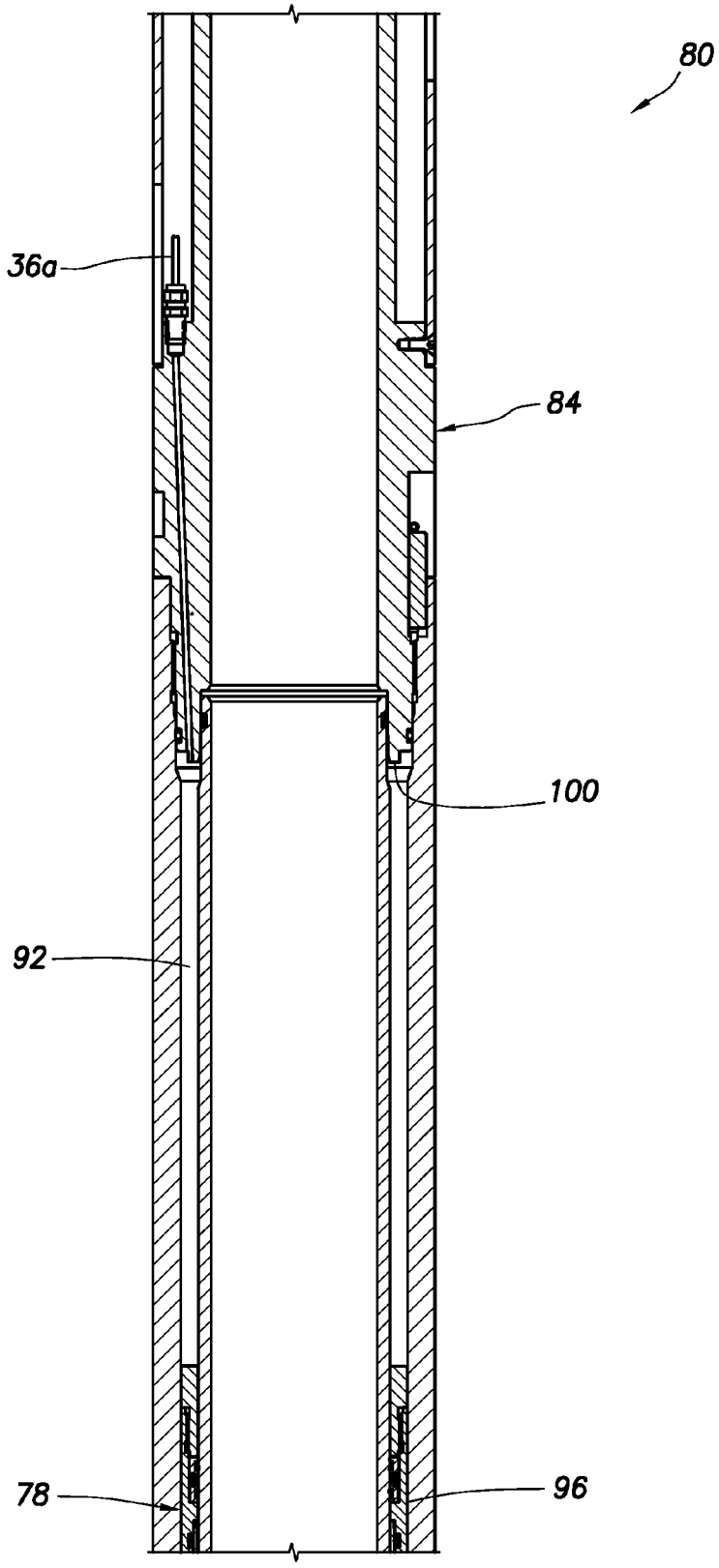
Figure 3C:
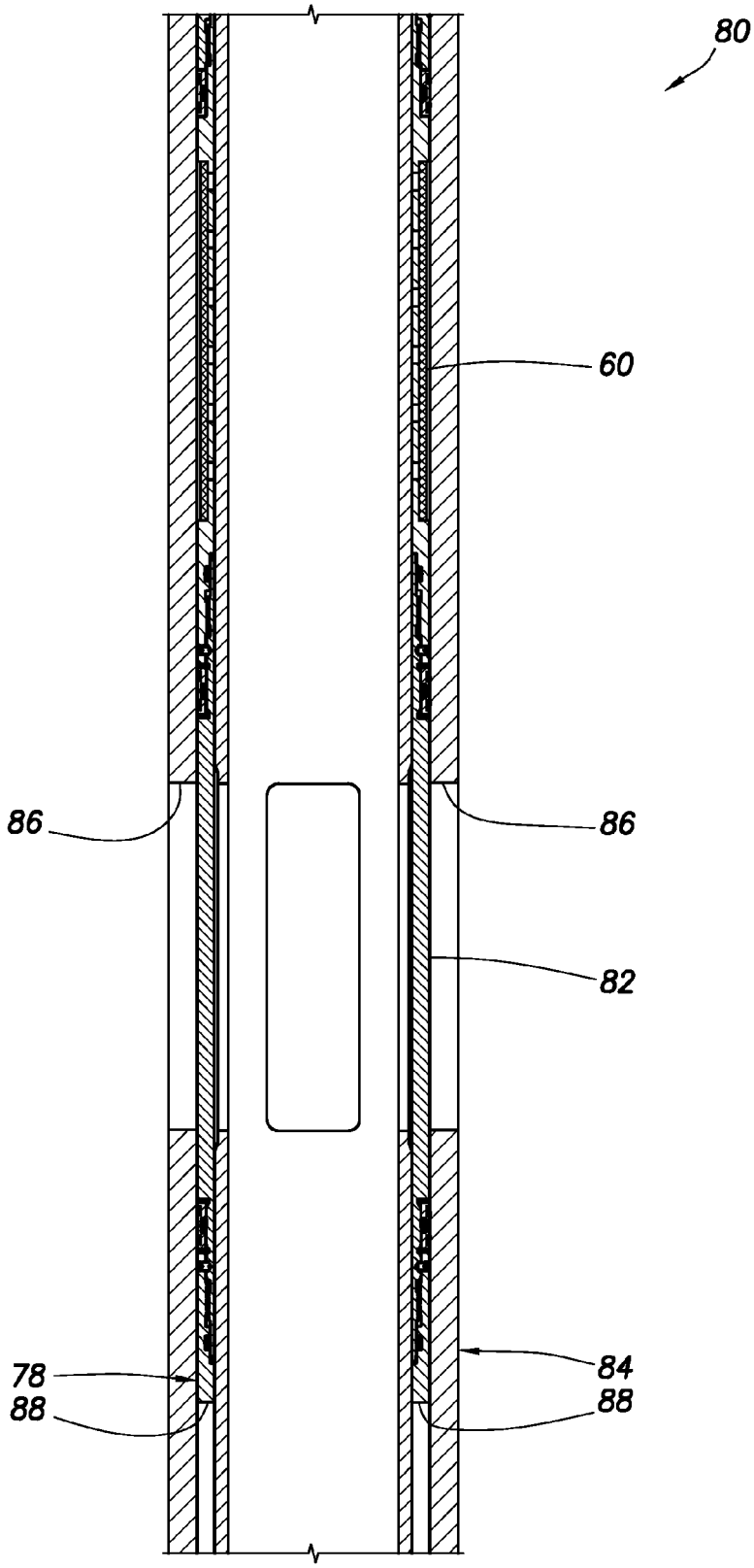
Figure 3D:
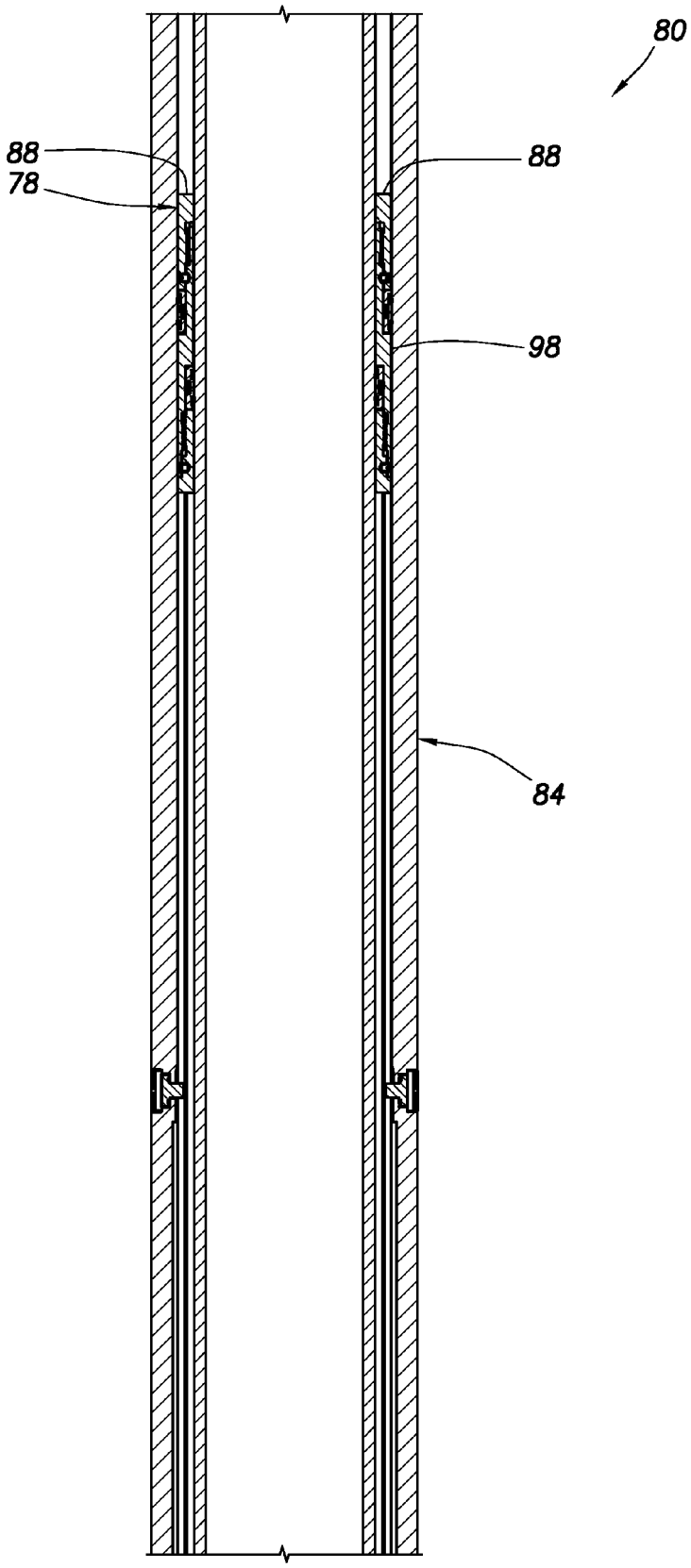
Figure 3E:
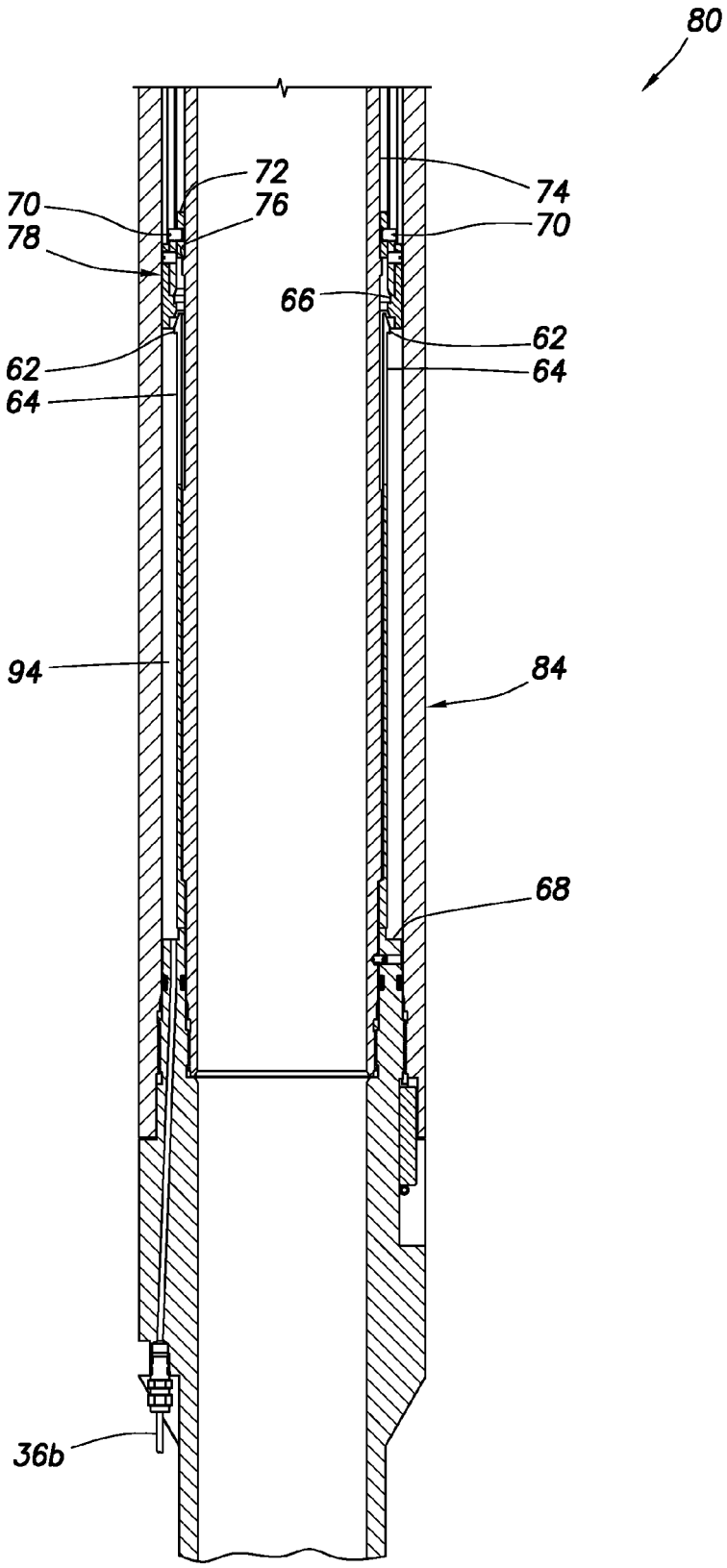

Referring additionally now to FIG. 2, another well system 170 and associated method incorporating principles of the invention are representatively illustrated. The well system 170 is similar in some respects to the well system 10 described above, and so similar elements have been indicated in FIG. 2 using the same reference numbers.

The well system 170 includes two wellbores 172, 174. Preferably, the wellbore 174 is positioned vertically deeper in the formation 176 than the wellbore 172. In the example depicted in FIG. 2, the wellbore 172 is directly vertically above the wellbore 174, but this is not necessary in keeping with the principles of the invention.

A set of valves 24, 26, 28 and lines 36 is installed in each of the wellbores 172, 174. The valves 24, 26, 28 are preferably interconnected in tubular strings 178, 180 which are installed in respective perforated liners 182, 184 positioned in open hole portions of the respective wellbores 172, 174. Although only three of the valves 24, 26, 28 are depicted in each wellbore in FIG. 2, any number of valves may be used in keeping with the principles of the invention.

The interval sets 14, 16, 18 are isolated from each other in an annulus 186 between the perforated liner 182 and the wellbore 172, and in an annulus 188 between the perforated liner 184 and the wellbore 174, using a sealing material 190 placed in each annulus. The sealing material 190 could be any type of sealing material (such as swellable elastomer, hardenable cement, selective plugging material, etc.), or more conventional packers could be used in place of the sealing material.

The interval sets 14, 16, 18 are isolated from each other in an annulus 192 between the tubular string 178 and the liner 182, and in an annulus 194 between the tubular string 180 and the liner 184, by packers 196.

In the well system 170, steam is injected into the interval sets 14, 16, 18 of the formation 176 via the valves 24, 26, 28 in the wellbore 172, and formation fluid is received from the formation into the valves 24, 26, 28 in the wellbore 174. Steam injected into the interval sets 14, 16, 18 is represented in FIG. 2 by respective arrows 198*a*, 198*b*, 198*c*, and formation fluid produced from the interval sets is represented in FIG. 2 by respective arrows 200*a*, 200*b*, 200*c*.

The valves 24, 26, 28 in the wellbores 172, 174 are used to control an interface profile 202 between the steam 198*a-c* and the formation fluid 200*a-c*. By controlling the amount of steam injected into each interval set, and the amount of formation fluid produced from each interval set, a shape of the profile 202 can also be controlled.

For example, if the steam is advancing too rapidly in one of the interval sets (as depicted in FIG. 2 by the dip in the profile 202 in the interval set 16), the steam injected into that interval set may be shut off or choked, or production from that interval set may be shut off or choked, to thereby prevent steam breakthrough into the wellbore 174, or at least to achieve a desired shape of the interface profile.

In the example of FIG. 2, the valve 26 in the wellbore 172 could be selectively closed or choked to stop or reduce the flow of the steam 198*b* into the interval set 16. Alternatively, or in addition, the valve 26 in the wellbore 174 could be selectively closed or choked to stop or reduce production of the formation fluid 200*b* from the interval set 16.

For steam injection purposes in the wellbore 172, the valves 24, 26, 28 (as well as the seal material 190 and packers 196) should preferably be provided with appropriate heat resistant materials and constructed to withstand large temperature variations. For example, the packers 196 in the wellbore 172 could be of the type known as ring seal packers.

The valves 24, 26, 28 in the wellbore 174 may be configured to permit filtering of the fluid 200*a-c* during formation testing, completion and/or production operations. The valves 24, 26, 28 are preferably selectively operable between closed and filtering positions, in order to reduce or eliminate production of formation fines, particulate matter, proppant, debris, etc, from the formation 176, and also to achieve a desired shape of the interface profile 202.

An enlarged scale schematic cross-sectional view of a valve 80 which may be used for any of the valves 22, 24, 26, 28 in the well system 10 and/or 170 is representatively illustrated in FIGS. 3A-E. The valve 80 may be used in other well systems in keeping with the principles of the invention.

The valve 80 is of the type known to those skilled in the art as a sliding sleeve valve, since it includes a closure member 82 in the form of a sleeve reciprocably displaceable relative to a housing assembly 84 to thereby selectively permit and prevent flow through openings 86 formed through a sidewall of the housing assembly. The closure member 82 is part of a closure assembly 78 which can also be used to selectively prevent and filter flow through the openings 86, as described more fully below.

The valve 80 is specially constructed for use in well systems and methods (such as the well system 10 and method of FIG. 1) in which the valve is to be operated after being cemented in a wellbore. Specifically, openings 88 formed through a sidewall of the closure member 82 are isolated from the interior and exterior of the valve 80 where cement is present during the cementing operation. The valve 80 is preferably closed during the cementing operation, as depicted in FIGS. 3A-E.

Although use of the valve 80 in the well system 10 is described (in which the valve is cemented in a wellbore), it should be clearly understood that the valve 80 is also suitable for use in well systems and methods (such as the well system 170 and method of FIG. 2) in which the valve is not cemented in a wellbore.

When it is desired to open the valve 80, the closure member 82 is displaced upward, thereby aligning the openings 86, 88 and permitting fluid communication between the interior and exterior of the housing assembly 84. The closure member 82 is displaced in the housing assembly 84 by means of pressure delivered via lines 36*a*, 36*b* externally connected to the valve 80.

The line 36*a* is in communication with a chamber 92, and the line 36*b* is in communication with a chamber 94, in the housing assembly 84. The lines 36*a*, 36*b* can be included in the lines 36 in the systems 10, 170 described above. A protective housing 90 is preferably used to prevent damage to the lines 36.

Pistons 96, 98 on the closure assembly 78 are exposed to pressure in the respective chambers 92, 94. In a first configuration of the valve 80, when pressure in the chamber 94 exceeds pressure in the chamber 92, the closure assembly 78 is biased by this pressure differential to displace upwardly to its open position. When pressure in the chamber 92 exceeds pressure in the chamber 94, the closure assembly 78 is biased by this pressure differential to displace downwardly to its closed position.

Note that, when the closure assembly 78 displaces between its open and closed positions (in either direction), the closure assembly is displacing into one of the chambers 92, 94, which are filled with clean fluid. Thus, no debris, sand, cement, etc. has to be displaced when the closure member 82 is displaced.

This is true even after the valve 80 has been cemented in the wellbore 20 in the well system 10. Although cement may enter the openings 86 in the outer housing 84 when the closure member 82 is in its closed position, this cement does not have to be displaced when the closure member is displaced to its open position.

An additional beneficial feature of the valve 80 is that the chambers 92, 94 and pistons 96, 98 are positioned straddling the openings 86, 88, so that a compact construction of the valve is achieved. For example, the valve 80 can have a reduced wall thickness and greater flow area as compared to other designs. This provides both a functional and an economic benefit.

A shoulder 100 at an upper end of the chamber 92 limits upward displacement of the closure assembly 78 in the first configuration of the valve 80. Another shoulder 76 formed on an inner mandrel 74 of the valve 80 limits downward displacement of the closure assembly 78.

A ring 72 is carried at a lower end of the closure assembly 78, and is secured in place with shear screws 70. The ring 72 abuts the shoulder 76 to prevent further downward displacement of the closure assembly 78 in the first configuration of the valve 80.

However, when it is desired to operate the valve 80 to its second configuration, pressure in the chamber 92 may be increased (or pressure in the chamber 94 may be decreased) to thereby apply a predetermined pressure differential across the pistons 96, 98 to shear the shear screws 70 and permit the closure assembly 78 to displace further downward. After the shear screws 70 have been sheared, downward displacement of the closure assembly 78 is limited by a shoulder 68 at a lower end of the chamber 94.

Another effect of shearing the screws 70 and downwardly displacing the closure assembly 78 is that an internal latching profile 66 on the closure assembly will be positioned below the upper ends of latching collets 64. Each of the collets 64 has an external latching profile 62 formed thereon for latching engagement with the internal profile 66.

Once the internal profile 66 has displaced downward past the external profiles 62, the engagement between the profiles will prevent the closure assembly 78 from displacing upwardly beyond the collets 64. In other words, the point of engagement between the profiles 62, 66 becomes a new limit for upward displacement of the closure assembly 78.

When the profiles 62, 66 are engaged at the upper limit of displacement of the closure assembly 78 in this second configuration of the valve 80, the closure member 82 is positioned opposite the openings 86, and flow through the openings is prevented. This position of the closure assembly 78 is achieved by increasing pressure in the chamber 94 relative to pressure in the chamber 92 to upwardly displace the closure assembly.

When the closure assembly 78 is downwardly displaced to abut the shoulder 68, a filter 60 will be positioned opposite the openings 86. In this position, fluid which flows through the openings 86 will be filtered by the filter 60. Thus, in formation testing, completion, production operations, etc., the filter 60 can prevent formation fines, proppant, debris and/or particulate matter from flowing into the casing string 21 from the formation 176.

This position of the closure assembly 78 (with the filter 60 positioned opposite the openings 86) is achieved by increasing pressure in the chamber 92 relative to pressure in the chamber 94 to downwardly displace the closure assembly. If it is desired to close the valve 80 and thereby prevent flow through the openings 86, pressure in the chamber 94 may be again increased relative to pressure in the chamber 92 to upwardly displace the closure assembly 78 (until the profiles 62, 66 engage) and position the closure member 82 opposite the openings 86.

Thus, in the first configuration of the valve 80 (prior to shearing the screws 70 and displacing the internal profile 66 downward past the external profiles 62), the valve is repeatedly operable between open and closed positions, and in the second configuration of the valve (after shearing the screws 70 and displacing the internal profile 66 downward past the external profiles 62), the valve is repeatedly operable between closed and filtering positions.

The filter 60 may be any type of filter or screen capable of filtering proppant, formation fines, debris, particulate matter, etc. from the formation fluid 200. For example, the filter 60 could be a sand control screen, a wire-wrapped screen, a wire mesh screen, a sintered screen, a pre-packed screen, a woven screen, small perforations, narrow slots, or any other type or combination of filters.

The capability of closing the valve 80 when it is in the second configuration can be useful in stimulation operations (to enable selective stimulation of different interval sets 12, 14, 16, 18) and in formation testing, completion and production operations to control flow of the fluid 200*a-c* from the formation 176. For example, in the well system 170, closing one or more of the valves 24, 26, 28 is useful for controlling the shape of the interface profile 202 during production operations.

Various different systems and methods may be used for controlling operation of the valve 80. Suitable systems and methods are described in International Application No. PCT/US07/61031, filed Jan. 25, 2007, the entire disclosure of which is incorporated herein by this reference. The control systems and methods described in the incorporated application are especially suited for remotely controlling operation of multiple valves 22, 24, 26, 28 interconnected in a casing string 21.

Seals used in the valve 80 may be similar to the seals described in International Application No. PCT/US07/60648, filed Jan. 17, 2007, the entire disclosure of which is incorporated herein by this reference. The seals described in the incorporated application are especially suited for high temperature applications.

It may now be fully appreciated that the present invention provides many benefits over prior well systems and methods for selectively stimulating wells and controlling flow in wells. Sequential and selective control of multiple valves is provided, without requiring intervention into a casing or other tubular string, and certain valves are provided which are particularly suited for being cemented along with a casing string, or use in high temperature environments, etc.

Specifically, the well systems 10, 170 described above may include at least one valve 80 interconnected in a casing string 21, the valve being selectively configurable between first and second configurations via one or more lines 36 external to the casing string 21. The valve 80 in the first configuration is operable to selectively permit and prevent fluid flow between an exterior and an interior of the casing string 21. The valve 80 in the second configuration is operable to selectively filter and prevent fluid flow between the exterior and interior of the casing string 21.

The valve 80 may be selectively configurable between the first and second configurations in response to pressure manipulation on the one or more lines 36. The valve 80 may be placed in the second configuration in response to a predetermined pressure being applied to at least one of the lines 36.

In the first configuration, a closure member 82 of the valve 80 may be selectively displaceable between a first position in which flow through an opening 86 of the valve is blocked and a second position in which flow through the opening is unblocked. In the second configuration, the closure member 82 may be selectively displaceable between the first position and a third position in which a filter 60 is operative to filter fluid flow through the opening 86. The filter 60 may be attached to the closure member 82 and may displace with the closure member in the second configuration.

A valve 80 is also described above for use in a tubular string 21 in a subterranean well. The valve 80 may include a closure member 82 displaceable between open and closed positions to thereby selectively permit and prevent flow through a sidewall of a housing assembly 84 when the valve is in a first configuration. The closure member 82 may also be displaceable between closed and filtering positions to thereby selectively prevent and filter flow through the housing assembly 84 sidewall when the valve 80 is in a second configuration. The valve 80 may be selectively configurable between the first and second configurations from a remote location without intervention into the well.

A control system 38 may be operative to manipulate pressure in one or more lines 36 externally connected to the valve 80 to select between the first and second configurations. The closure member 82 may be displaceable between the open and closed positions in response to a change in pressure in at least one of the lines 36 externally connected to the valve 80. The closure member 82 may be displaceable between the closed and filtering positions in response to a change in pressure in at least one of the lines 36 externally connected to the valve 80.

In the first configuration, the closure member 82 may be selectively displaceable between the closed position in which flow through an opening 86 of the valve 80 is blocked and the open position in which flow through the opening is unblocked. In the second configuration, the closure member 82 may be selectively displaceable between the closed position and the filtering position in which a filter 60 is operative to filter fluid flow through the opening 86. The filter 60 may be attached to the closure member 82 and displace with the closure member in the second configuration.

A method of selectively stimulating a subterranean formation 176 is also described above. The method may include the steps of: positioning a casing string 21 in a wellbore 20 intersecting the formation 176, the casing string including at least one valve 80 operable to selectively permit and prevent fluid flow between an interior and an exterior of the casing string, the valve being operable via one or more lines 36 externally connected to the valve; and for at least one interval set 12, 14, 16, 18 of the formation 176, stimulating the interval set by opening the valve 80, flowing a stimulation fluid 30 from the interior of the casing string 21 and into the interval set, and then configuring the valve to filter fluid 200*a-c* which flows from the formation into the casing string.

The method may also include the step of, prior to the stimulating step, cementing the casing string 21 and lines 36 in the wellbore 20. At least one of the lines 36 may be positioned external to the casing string 21 during the cementing step.

The valve opening and configuring steps may be performed by manipulating pressure in at least one of the lines 36. The valve opening and configuring steps may be performed without intervention into the casing string 21. The valve opening and configuring steps may be performed without application of pressure to the casing string 21.

The method may also include the step of testing the interval set by opening the valve 80, and flowing a formation fluid 200*a-c* from the interval set and into the interior of the casing string 21. The testing step may be performed after the stimulating step.

The method may also include the steps of repeatedly displacing a closure member 82 of the valve 80 between open and closed positions in a first configuration of the valve and then, after the configuring step, repeatedly displacing the closure member between closed and filtering positions in a second configuration of the valve.

Of course, a person skilled in the art would, upon a careful consideration of the above description of representative embodiments of the invention, readily appreciate that many modifications, additions, substitutions, deletions, and other changes may be made to the specific embodiments, and such changes are contemplated by the principles of the present invention. Accordingly, the foregoing detailed description is to be clearly understood as being given by way of illustration and example only, the spirit and scope of the present invention being limited solely by the appended claims and their equivalents.

What is claimed is:

1. A well system, comprising:

a valve interconnected in a casing string, the valve selectively and alternately permits and prevents fluid flow between an exterior and an interior of the casing string in a first configuration, and the valve selectively and alternately filters and prevents fluid flow between the exterior and the interior of the casing string in a second configuration; and at least one line connected to the valve, wherein the line changes the valve from the first configuration to the second configuration, and wherein after the valve changes from the first configuration to the second configuration, the valve is prevented from changing from the second configuration to the first configuration.

2. The system of claim 1, wherein the valve is selectively configurable between the first and second configurations in response to pressure manipulation on the at least one line.

3. The system of claim 1, wherein the valve is placed in the second configuration in response to a predetermined pressure being applied to the at least one line.

4. The system of claim 1, wherein in the first configuration a closure member of the valve is selectively displaceable between a first position in which fluid flow through an opening of the valve is blocked and a second position in which fluid flow through the opening is unblocked, and wherein in the second configuration the closure member is selectively displaceable between the first position and a third position in which fluid flow through the opening is filtered.

5. The system of claim 4, wherein a filter is attached to the closure member and displaces with the closure member in the second configuration.

6. A valve for use in a tubular string in a subterranean well, the valve comprising:

a closure member displaceable between open and closed positions in which fluid flow is selectively and alternately permitted and prevented through a sidewall of a housing assembly when the valve is in a first configuration, the closure member further being displaceable between closed and filtering positions in which fluid flow through the housing assembly sidewall is selectively and alternately prevented and filtered when the valve is in a second configuration; and a latching means which limits displacement of the closure member when the valve is in the second configuration thereby preventing the valve from returning to the first configuration.

7. The valve of claim 6, wherein a control system manipulates pressure in at least one line connected to the valve thereby changing from the first configuration to the second configuration.

8. The valve of claim 6, wherein the closure member is displaceable between the open and closed positions in response to a change in pressure in at least one line connected to the valve.

9. The valve of claim 6, wherein the closure member is displaceable between the closed and filtering positions in response to a change in pressure in at least one line connected to the valve.

10. The valve of claim 6, wherein in the first configuration the closure member is selectively displaceable between the closed position in which fluid flow through an opening of the valve is blocked and the open position in which fluid flow through the opening is unblocked, and wherein in the second configuration the closure member is selectively displaceable between the closed position and the filtering position in which fluid flow through the opening is filtered.

11. The valve of claim 10, wherein a filter is attached to the closure member and displaces with the closure member in the second configuration.

12. A method of selectively stimulating a subterranean formation, the method comprising the steps of:

positioning a casing string in a wellbore intersecting the formation, the casing string including at least one valve which selectively and alternately permits and prevents fluid flow between an interior and an exterior of the casing string in a first configuration, and which selectively and alternately filters and prevents fluid flow between the interior and the exterior of the casing string in a second configuration, the valve being operated via at least one line connected to the valve;

stimulating at least one interval set of the formation by opening the valve and flowing a stimulation fluid from the interior of the casing string into the interval set while the valve is in the first configuration;

then irreversibly changing the valve from the first configuration to the second configuration; and then filtering fluid which flows from the formation through the valve into the casing string.

13. The method of claim 12, further comprising the step of, prior to the stimulating step, cementing the casing string and line in the wellbore.

14. The method of claim 13, wherein the line is positioned external to the casing string during the cementing step.

15. The method of claim 12, wherein the opening and configuring steps are performed by manipulating pressure in the line.

16. The method of claim 12, wherein the opening and configuring steps are performed without intervention into the casing string.

17. The method of claim 12, wherein the opening and configuring steps are performed without application of pressure to the interior of the casing string.

18. The method of claim 12, further comprising the step of testing the interval set by opening the valve and flowing a formation fluid from the interval set into the interior of the casing string.

19. The method of claim 18, wherein the testing step is performed after the stimulating step.

20. The method of claim 12, further comprising the steps of repeatedly displacing a closure member of the valve between open and closed positions in a first configuration of the valve and then, after the configuring step, repeatedly displacing the closure member between closed and filtering positions in a second configuration of the valve.

* * * * *